US010612403B2

(12) United States Patent
Stastny et al.

(10) Patent No.: US 10,612,403 B2
(45) Date of Patent: Apr. 7, 2020

(54) COMBUSTOR SLIDING JOINT

(71) Applicant: PRATT & WHITNEY CANADA CORP., Longueuil (CA)

(72) Inventors: Honza Stastny, Georgetown (CA); Robert Sze, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 662 days.

(21) Appl. No.: 14/454,366

(22) Filed: Aug. 7, 2014

(65) Prior Publication Data

US 2016/0040543 A1 Feb. 11, 2016

(51) Int. Cl.
*F01D 9/02* (2006.01)
*F23R 3/60* (2006.01)

(52) U.S. Cl.
CPC ..... *F01D 9/023* (2013.01); *F23R 3/60* (2013.01); *F23R 2900/00005* (2013.01); *F23R 2900/00012* (2013.01)

(58) Field of Classification Search
CPC .. F01D 9/023; F01D 25/28; F02C 7/20; F23R 3/60; F23R 2900/00012
See application file for complete search history.

(56) References Cited

U.S. PATENT DOCUMENTS 4,485,630 A * 12/1984 Kenworthy ..... B23P 15/00 416/97 R
5,407,319 A 4/1995 Harrogate et al.
6,347,508 B1 * 2/2002 Smallwood ..... F01D 9/023 60/796
7,000,406 B2 2/2006 Markarian et al.
7,269,958 B2 * 9/2007 Stastny ..... F23R 3/002 60/752
7,350,358 B2 4/2008 Patel et al.
7,954,326 B2 * 6/2011 Lai ..... F01D 9/023 60/752
8,001,793 B2 * 8/2011 Patel ..... B23P 6/005 60/752
8,166,767 B2 5/2012 Grivas et al.
(Continued)

FOREIGN PATENT DOCUMENTS

GB 2102897 2/1983

OTHER PUBLICATIONS

Office Action, Canadian Patent Application No. 2899774, dated Jun. 26, 2016.

(Continued)

*Primary Examiner* — Carlos A Rivera
(74) *Attorney, Agent, or Firm* — Norton Rose Fulbright Canada LLP

(57) ABSTRACT

A sliding joint in a gas turbine engine between a large exit duct of a combustor and a turbine vane assembly having a leading edge lug. The sliding joint has an elongated flexible arm extending between a first end joined to the outer surface of the large entry duct, and an opposed free second end disposed radially inward of the outer surface of the large entry duct. A spacer is joined to the second end of the arm and projects radially away therefrom toward the outer surface of the large entry duct. The spacer is spaced apart from the outer surface and defines a gap therebetween. The spacer, the arm, and the sliding joint axially displace with respect to the lug upon thermal expansion of the large entry duct.

13 Claims, 6 Drawing Sheets

(56) References Cited

U.S. PATENT DOCUMENTS

| | | | | |
|---|---|---|---|---|
| 8,407,893 | B2 * | 4/2013 | Patel | B23P 6/005 29/890.01 |
| 8,534,076 | B2 | 9/2013 | Woodcock et al. | |
| 2002/0162331 | A1 * | 11/2002 | Coutandin | F23R 3/08 60/752 |
| 2005/0120718 | A1 * | 6/2005 | Markarian | F01D 9/023 60/800 |
| 2009/0133404 | A1 | 5/2009 | Lai et al. | |
| 2014/0338346 | A1 * | 11/2014 | Stastny | F23R 3/06 60/754 |
| 2014/0366544 | A1 * | 12/2014 | MacCaul | F23R 3/002 60/752 |
| 2015/0226131 | A1 * | 8/2015 | Low | F01D 9/023 60/796 |

OTHER PUBLICATIONS

Office Action, Canadian Patent Application No. 2899774, dated Apr. 12, 2018.

* cited by examiner

COMBUSTOR SLIDING JOINT

TECHNICAL FIELD

The application relates generally to gas turbine engines and, more particularly, to a gas turbine engine.

BACKGROUND

Current manufacturing techniques for combustors of gas turbine engines employ laser drilling. Laser drilling allows the production of thousands of effusion holes throughout the combustor, which provides the combustor with improved cooling. Effusion holes, however, require that the sheet metal used to make the combustor be thicker than combustors which employ other cooling techniques. This change in the thickness of the outer liner of the combustor affects the stiffness of the combustor, and can negatively affect the support structures used to secure the combustor in place.

Furthermore, as the axial length of the combustor with respect to its surrounding parts increases due to thermal growth, the combustor generates loads which act against its support mounts. These loads can cause increased wear of the support structures and the support bosses (known as "fretting"). Over time, fretting can affect the combustor by jeopardizing operability due to leakage of combustion gases, and reducing the useful life of the combustor.

SUMMARY

In one aspect, there is provided a sliding joint between a large exit duct of a combustor of a gas turbine engine and a turbine vane assembly having a leading edge lug, the large exit duct having a distal flange defining an inner surface and outer surface, the sliding joint comprising: an elongated flexible arm extending between a first end joined to the outer surface of the distal flange and an opposed free second end disposed radially inward of the distal flange, the flexible arm having a first surface and a second surface spaced radially inward from the first surface; and a spacer joined to the first surface of the second end of the flexible arm and projecting radially away therefrom toward the distal flange, the spacer spaced apart from the distal flange and defining a gap therebetween, the spacer axially displacing with respect to the lug upon thermal expansion of the large exit duct.

There is also provided a gas turbine engine, comprising: a combustor defining a flowpath extending downstream from an upstream dome end towards a combustor exit, the dome end interconnecting a large exit duct and a small exit duct to defining a combustion chamber therewithin, the large exit duct having a distal flange defining an inner surface facing the combustion chamber, and an outer surface; a turbine vane assembly disposed downstream of the combustor and having at least one turbine vane and a leading edge lug; and a sliding joint disposed between the combustor and the turbine vane assembly, the sliding joint comprising: an elongated flexible arm extending between a first end joined to the outer surface of the distal flange of the large exit duct, and an opposed free second end disposed radially inward of the distal flange, the flexible arm having a first surface and a second surface spaced radially inward from the first surface; and a spacer joined to the first surface of the second end of the flexible arm and projecting radially away therefrom toward the distal flange, the spacer spaced apart from the distal flange and defining a gap therebetween, the spacer axially displacing with respect to the lug upon thermal expansion of the large exit duct of the combustor.

There is further provided a method of absorbing thermal growth mismatch between a combustor and a downstream turbine vane assembly in a gas turbine engine, comprising: providing a sliding joint between a long exit duct of the combustor and an inner vane platform of the turbine vane assembly, including: joining a first end of an elongated flexible arm to an outer surface of the long exit duct; placing a free second end of the flexible arm radially inward of the outer surface and adjacent to a leading edge lug of the turbine vane assembly; and displacing the second end of the flexible arm along an axial direction with respect to the lug of the turbine vane assembly when the combustor undergoes thermal expansion.

BRIEF DESCRIPTION OF THE DRAWINGS

Reference is now made to the accompanying figures in which.

DETAILED DESCRIPTION

Figure 1:
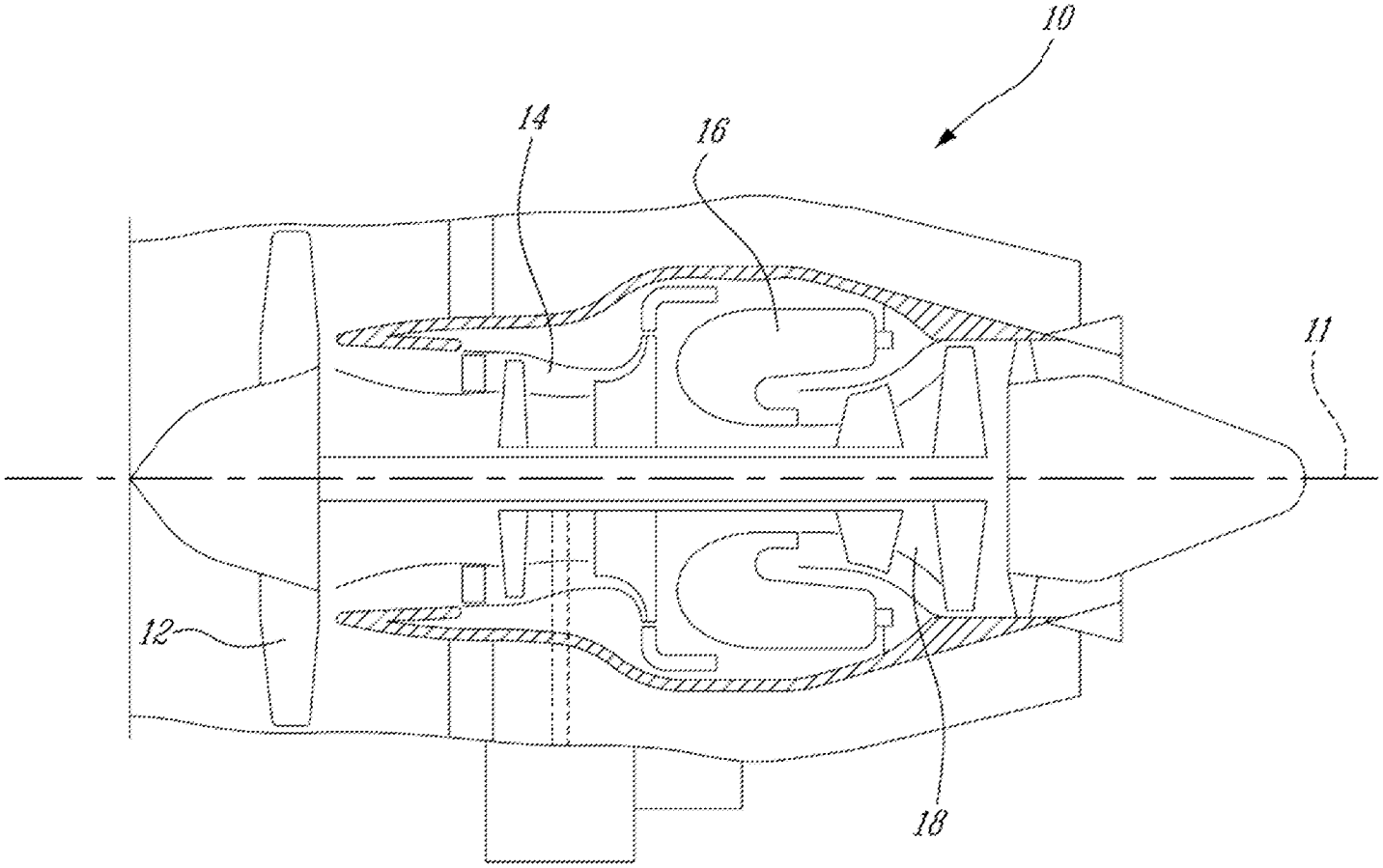
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The gas turbine engine 10 extends along a longitudinal center axis 11.

Figure 2:
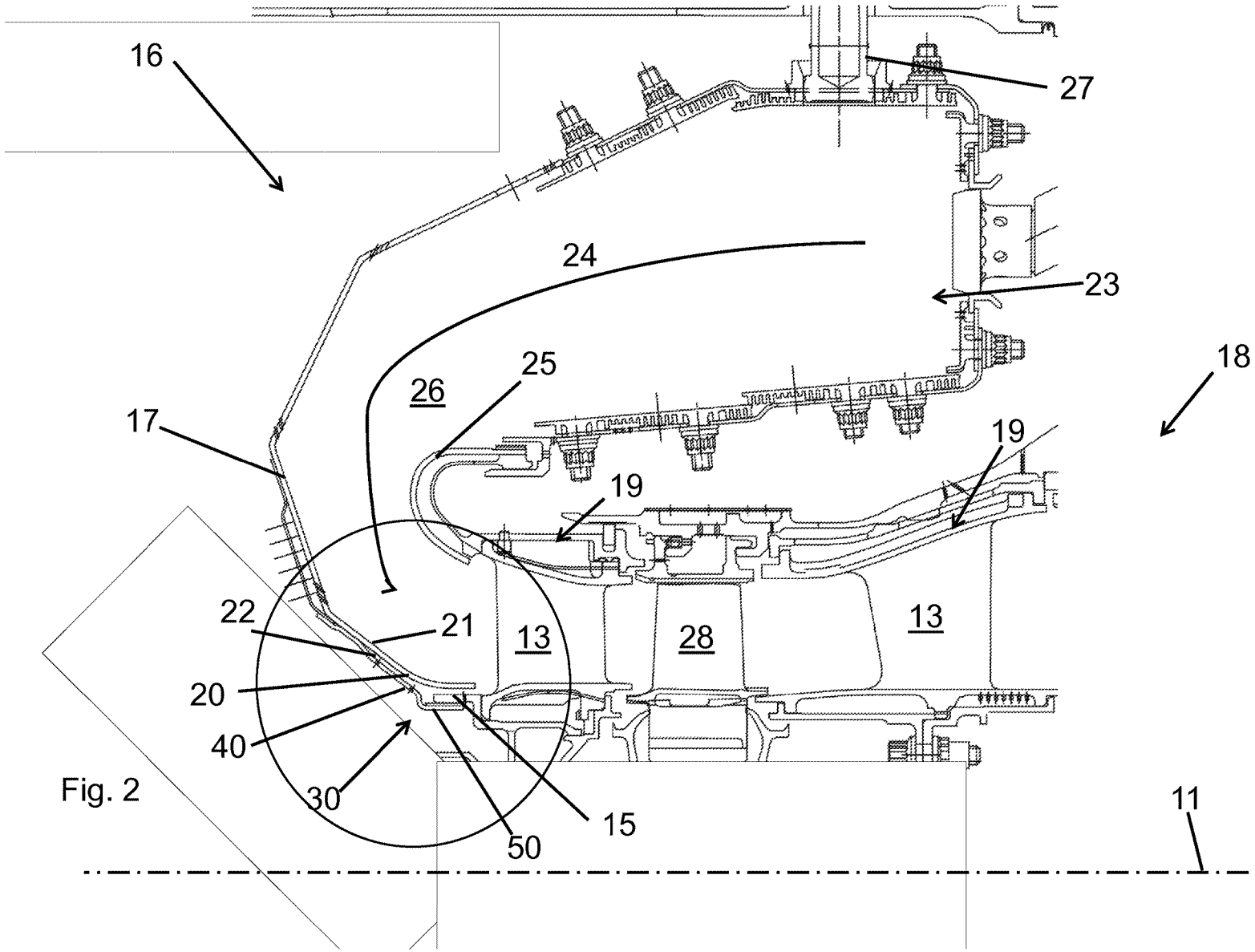
FIG. 2 is cross-sectional view of a combustor and a turbine vane assembly of the gas turbine engine of FIG. 1, the combustor having a sliding joint according to an embodiment of the present disclosure.

Referring now to FIG. 2, a portion of the turbine section 18, namely turbine vane assemblies 19, is downstream from the reverse-flow combustor 16, which is secured to the structure of the engine via radial or axial support pins 27. The combustor 16 has a dome end 23 in which fuel is mixed with air and combusted, thereby generating the annular stream of hot combustion gases. The combustion gases flow away from the dome end 23 along a flowpath 24 in a downstream direction. The flowpath 24 of the combustion gases extends along and through both the large exit duct (LED) 17 and the small exit duct (SED) 25 of the combustor 16. The dome 23, LED 17 and SED 25 collectively define a combustion chamber 26 therewithin, in which combustion of the fuel/air mixture occurs and through which the flowpath 24 extends. Both the LED 17 and the SED 25 convey the combustion gases downstream toward an exit of the combustor 16, and ultimately, into the turbine vane assembly 19.

The component of the LED 17 nearest the exit of the combustor 16 is a distal flange 20, which is also generally referred to as the LED exit panel. The distal flange 20 is disposed at the downstream end of the LED 17 at the combustor exit. The LED 17 is typically a continuous annular body about the center axis 11. The distal flange 20, or the LED exit panel, joins the LED 17 of the combustor 16 to the turbine vane assembly 19. The distal flange 20 has an inner surface 21 which extends along the flowpath 24 and is directly exposed to the combustion gases, and an outer surface 22 which forms the exterior surface of the distal flange 20.

The one or more turbine vane assemblies 19 are disposed downstream of the combustor 16 and receive therefrom the combustion gases. Each turbine vane assembly 19 includes turbine vanes 13. The turbine section 18 has turbine rotors 28 spaced between the turbine vanes 13. The turbine vane assembly 19 also has a leading edge lug 15, which can be any structural support used to hoist and mount the turbine vane assembly 19. The lug 15 is generally part of the high-pressure turbine hub. The lug 15 may form part of the leading edge of the turbine vane assembly 19, meaning that it is typically the upstream portion of the high-pressure vane inner platform. The distal flange 20 generally overlaps the lug 15 such that it is disposed radially outward of the lug 15 and faces the lug 15 across a radial gap.

As previously explained, the exit of the combustor 16 and most upstream turbine vane assembly 19 are interconnected. More specifically, a sliding joint 30 interconnects the LED 17 of the combustor 16 and is abutted against the leading edge lug 15 of the inner platform of the first turbine vane assembly 19. The sliding joint 30 allows the LED 17, and thus the combustor 16, to be displaced at least along a longitudinal, or axial, direction parallel to the center axis 11 relative to the lug 15 of the turbine vane assembly 19 when the LED 17 undergoes thermal expansion due to the hot combustion gases. In so doing, the sliding joint 30 helps to reduce or eliminate some of the loads acting on the support pins 27 and other retaining structures which hold the combustor 16 in position. This in turn helps to lower the instances of fretting, thereby lowering the wear experienced by these support components.

The sliding joint 30 disclosed herein generally relates to the LED 17, and is thus sometimes known as an "inner joint" because it is the joint of the combustor 16 which is most radially inward (i.e. closer to the center axis 11 along a direction radial thereto). It will be appreciated that the sliding joint 30 disclosed herein can also be used to join the SED 25 to the turbine vane assembly 19, and can thus be an "outer joint" (i.e. disposed radially furthest away from the engine center axis 11).

In such a configuration, the distal flange 20 of the LED 17 can act as a heat shield to shield the sliding joint 30 and its components from the elevated temperatures of the combustion gases.

Figure 3:
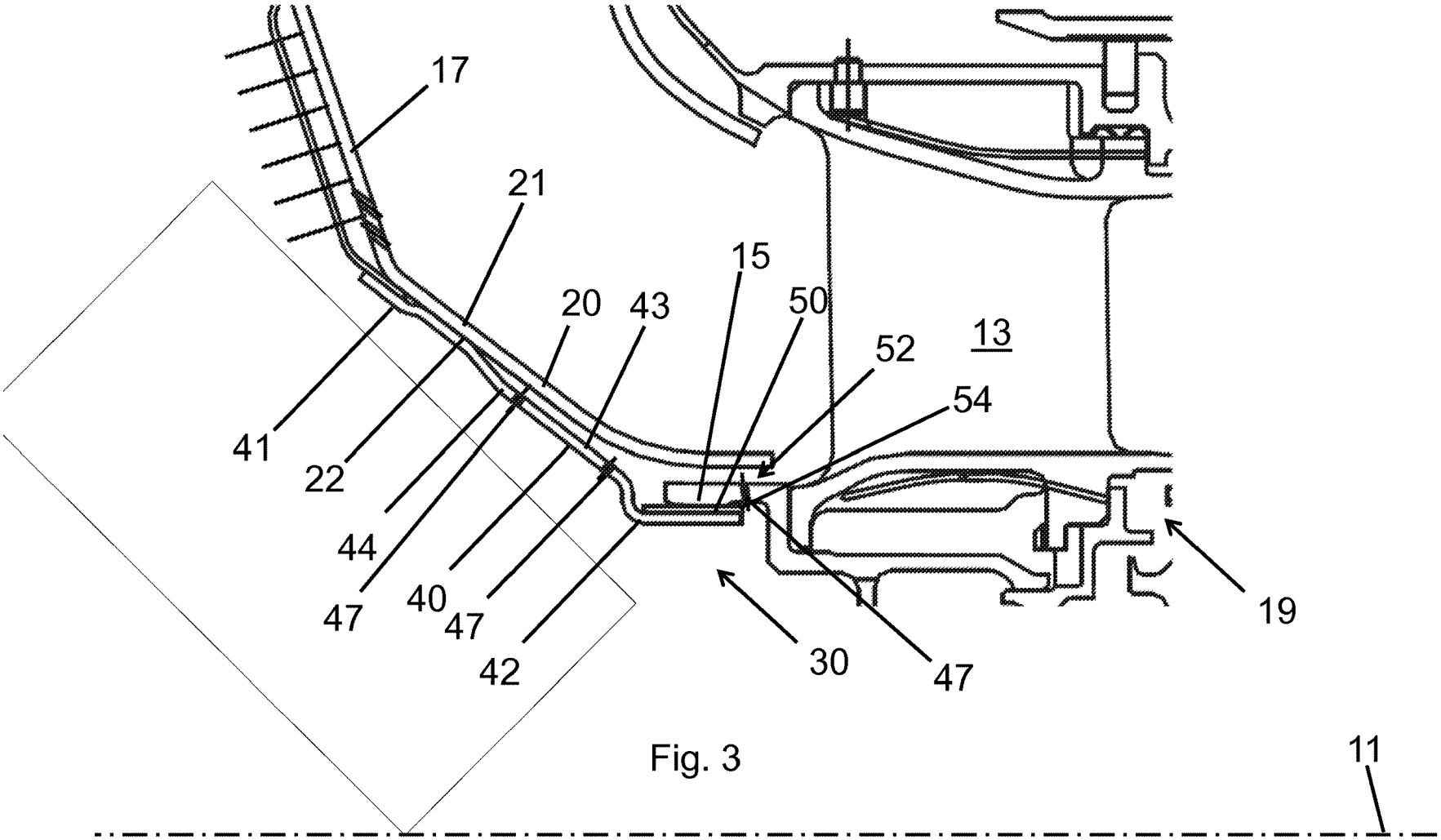
FIG. 3 is an enlarged view of the circled portion of FIG. 2.

Referring now to FIG. 3, the sliding joint 30 has an elongated flexible arm 40 attached to the combustor 16, and a spacer 50 attached to the arm 40, both of which are now described in greater detail. The elongated flexible arm 40 forms the body of the sliding joint 30, is connected to the LED 17, and is in spaced relation with the lug 15 of the turbine vane assembly 19. The arm 40 is generally a circumferential or annular body which is coaxial with the center axis 11 of the engine 10. As such, the arm 40 has a generally circumferential outer first surface 43, and a circumferential, inner second surface 44 which is spaced radially inward from the first surface 43 with respect to the engine center axis 11. The arm 40 is made from a resilient sheet metal which can be manipulated in order to adapt the arm 40 to the specific shape and contour of the LED 17 and/or turbine vane assembly 19 with which it will be used. Such resiliency or flexibility allows for elastic deformation of the arm 40, when required, and is generally derived from the material properties of the sheet metal itself. Furthermore, the arm 40 can have one or more cooling holes 47 which extend through the thickness of the arm 40 between the first surface 43 and the second surface 44. As their name suggests, these holes 47 help to circulate cooler air through the material of the arm 40, thereby helping to cool the arm 40 and the distal flange 20. If additional cooling is desired, the lug 15 can also have one or more cooling holes 47.

The arm 40 is elongated in that it extends along a length between a first end 41 which is welded, brazed, bolted, or otherwise joined to the outer surface 22 of the distal flange 20, and a free second end 42. The term "free" as used to describe the second end 42 refers to the fact that it is not attached or joined to another body or component, but is instead placed in proximity to the lug 15 of the turbine vane assembly 19. More specifically, the free second end 42 is located radially inward of the distal flange 20. The expressions "radially inward", "inward", and "outward" as used throughout the disclosure refers to the position of a component with respect to another, and with relation to a radial line emanating from the center axis 11. For example, the second end 42 is located radially inward of the distal flange 20, meaning that it is disclosed closer than the distal flange 20 to the center axis 11 along a direction radial thereto. Indeed, since most components of the sliding joint 30 are coaxial with the center axis 11, their relative positions can be described with respect to radial lines from the center axis 11.

The position of the second end 42 of the arm 40 with respect to the leading edge lug 15 of the turbine vane assembly 19 can vary. For example, and as shown in FIG. 3, the first surface 43 of the second end 42 can be disposed both radially inward of the distal flange 20, and radially inward of the lug 15 in opposed spaced relation therewith. More specifically, the first surface 43 of the second end 42 can be disposed so as to face a radially-inward surface of the lug 15 across a gap 54. In such a configuration of the second end 42, the lug 15 can be disposed radially between the second end 42 and the distal flange 20, such that the second end 42 is disposed radially inward of the lug 15, and such that the lug 15 is disposed radially inward of the distal flange 20. Such a configuration of the second end 42, the lug 15, and the distal flange 20 can form a sufficiently tight seal so as to prevent the egress of hot combustion gases from within the combustor 16, while still providing sufficient spacing to allow the second end 42 to be axially displaced relative to the lug 15.

Figure 4:
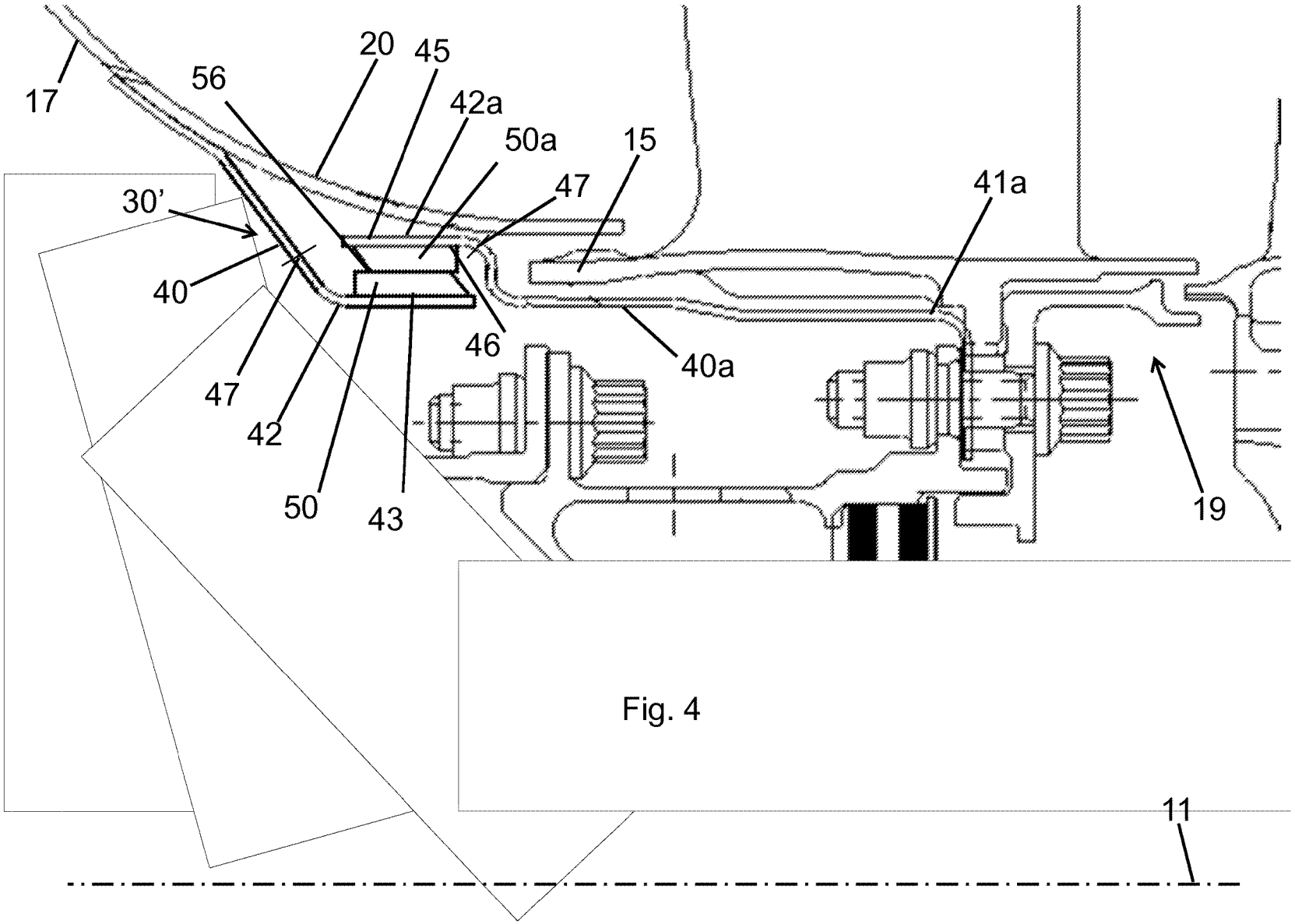
FIG. 4 is a cross-sectional view of a sliding joint having two flexible arms and two spacers, according to yet another embodiment of the present disclosure.

Alternatively, and as shown in FIG. 4, the sliding joint 30' can have a second elongated flexible arm **40*a* extending between a fixed end 41*a* joined to the turbine vane assembly 19, at any suitable point thereon, and an opposed unattached end 42*a* disposed radially inward of the distal flange 20. The second arm 40*a* has a generally circumferential third surface 45 and a fourth surface 46 spaced radially inward of the third surface 45. In such an embodiment, the fourth surface 46 of the unattached end 42*a* is radially outward of, and facing, the first surface 43 of the second end 42. The free ends 42,42*a* of the arms 40,40*a* are disposed radially inward of the distal flange 20 and in proximity to the lug 15 of the turbine vane assembly 19, but not necessarily radially inward thereof. Indeed, the free ends 42,42***a* can be disposed away from the lug 15 along a direction parallel to the center axis 11 of the engine 10.

Returning to FIG. 3, the sliding joint 30 also has a spacer 50, which is disposed in the space between the free second end 42 of the arm 40 and the outer surface 22 of the distal flange 20. The spacer 50 fills a space between the first surface 43 of the second end 42 of the arm 40, and the outer surface 22 of the distal flange 20. In so doing, the spacer 50 "mates" with the lug 15, and provides a tight tolerance between these two surfaces, thereby preventing the egress of combustion gases from the junction of the turbine vane assembly 19 and the distal flange 20, while still allowing for relative axial displacement of the distal flange 20 with respect to the turbine vane assembly 19 upon thermal expansion of the combustor 16. The axial displacement of the spacer 50 and the components linked thereto generally refers to a sliding motion along a direction which is parallel to the center axis 11. In most instances, the distal flange 20 will slide axially towards the leading edge of the turbine vane 13 upon undergoing thermal expansion.

The spacer 50 is typically a circumferential or annular sheet metal body which is welded, brazed, or otherwise joined to the first surface 43 of the second end 42 of the arm 40. The spacer 50 has a body which projects away from the first surface 43 in a radial direction and toward the outer surface 22 of the distal flange 20. The spacer 50 does not engage, or otherwise enter into contact, with the outer surface 22, and therefore defines a gap 52 between it and the outer surface 22 of the distal flange 20. It will be appreciated that this gap 52 is a relatively small distance. When the spacer 50 is spaced apart from the outer surface 22 with no lug 15 between the two components, the relatively small gap 52 helps the spacer 50 to form a barrier preventing the egress of hot combustion gases while still permitting axial displacement of the distal flange 20 relative to the turbine vane assembly 19.

As with the arm 40, the spacer 50 can have different shapes and be disposed in different locations with respect to the turbine vane assembly 19.

Still referring to FIG. 3, where the second gap 54 is shown between the first surface 43 of the second end 42 and the lug 15 of the turbine vane assembly 19, the spacer 50 can project radially away from the first surface 43 within the second gap 54 and toward the lug 15. In so doing, the spacer 50 almost completely fills the second gap 54, thereby providing the desired tight tolerance between the second end 42 of the arm 40 and the lug 15 and allowing the distal flange (and thus the arm 40 joined thereto) to be axially displaced upon thermal expansion of the LED 17.

Alternatively, and as shown in FIG. 4, the sliding joint 30' can have another, second spacer 50*a*. The second spacer 50*a* is welded or otherwise joined to the fourth surface 46 of the unattached end 42*a* of the arm 40*a*, and projects radially inward toward the spacer 50 attached to the second end 42 of the arm 40. A spacer gap 56 is defined between the exposed faces of the spacers 50,50*a*, which are spaced apart from another and define a tight tolerance therebetween. In such an embodiment, both spacers 50,50*a* and both arms 40,40*a* are located radially inward of the distal flange 20. The spacer gap 56 therefore allows the distal flange 20, and thus the spacer 50 and the arm 40 linked thereto, to be axially displaced with respect to the second spacer 50*a* (which is fixed in position to the turbine vane assembly 19) when the LED 17 undergoes thermal expansion during operation of the engine 10.

Figure 6:
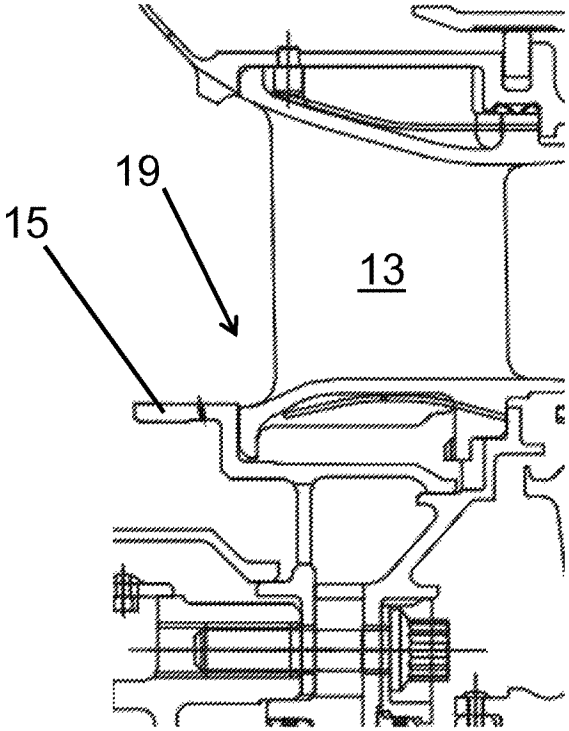
FIG. 6 is an enlarged cross-sectional view of the turbine vane assembly of FIG. 2.
Figure 5A:
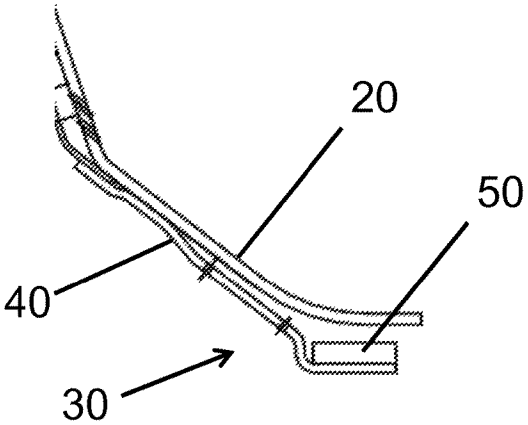
FIG. 5A is a cross-sectional view of a sliding joint having a flexible arm and a spacer, according to another embodiment of the present disclosure.
Figure 5B:
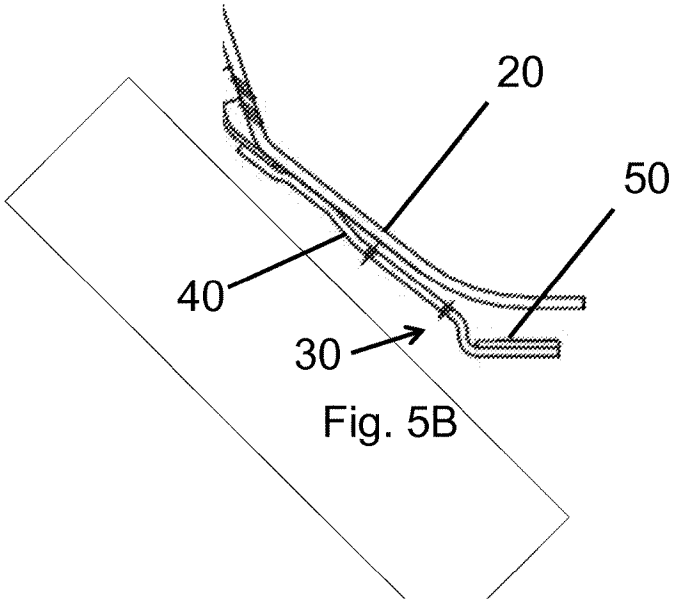
FIG. 5B is a cross-sectional view of the sliding joint of FIG. 5A, the spacer being shown after having been abraded.

Referring now to FIGS. 5A to 6, the arm 40 and spacer 50 of the sliding joint 30 can be adapted prior to assembly of the distal flange 20 with the lug 15 of the turbine vane assembly 19. More specifically, the arm 40 can be made from a circumferential sheet metal having a relatively high coefficient of expansion, such as Hastaloy X, and having a first gauge or thickness. Indeed, the arm 40 can be made from a material having a higher coefficient of expansion than the material of the distal flange 20 in order to reduce the thermal fight between the relatively hot distal flange 20 and the colder arm 40. The spacer 50 can be made from a different circumferential sheet metal have a second gauge or thickness. The second gauge of the spacer 50 can be greater (i.e. thicker) than the first gauge of the arm 40. The thinner material of the arm 40 provides it with greater flexibility and resiliency when compared to the thicker material of the spacer 50. The thicker material of the spacer 50 provides stock for final machining, which is generally performed after a final heat treatment of the joint 30. Furthermore, the use of two different gauges can also help lower manufacturing costs, in that welding two separate pieces of sheet metal together is generally less expensive than employing a forged ring that would need to be welded to the first surface of the arm 40.

The final machining of the spacer 50 refers to the fact that it can be abraded or otherwise ground down in order to provide the desired tight tolerance between it and the distal flange 20, or the inner radial surface of the lug 15. This is more clearly appreciated by contrasting FIGS. 5A and 5B. In FIG. 5A, the spacer 50 is shown in its pre-abraded stated, whereas in FIG. 5B, the spacer 50 has been abraded down to the size required in order to provide the desired tight tolerance. The final machining of the spacer 50 is performed based on the desired diameter tolerance and concentricity, amongst other possible factors.

In light of the preceding, it will be appreciated that the sliding joint 30 is located on the "cold side" of the combustor 16 (i.e. away from the combustion chamber 26, and outside the flowpath 24 of the hot combustion gases). The positioning and welding of the arm 40 along the colder outer surface 22 of the distal flange 20 of the LED 17 provides the arm 40 (and thus the joint 30) with greater flexibility to absorb the thermal gradient between the first end 41 and the free second end 42, thereby increasing durability. Furthermore, such positioning limits the exposure of the arm 40 and lug 15 to the T4 temperatures of the hot combustion gases. The arm 40 and lug 15 are therefore shielded from such temperatures by the distal flange 20, which helps to keep them and the spacer 50 at approximately the same temperature during operation of the engine 10. The arm 40, lug 15, and the spacer 50 therefore undergo a similar amount of thermal expansion, in comparison to certain prior art joints in which a portion of the arm is placed within the combustion chamber or is exposed to the hot combustion gases, thereby causing unequal thermal expansion and limiting the effectiveness of the joint. Further advantageously, the approximately same temperatures of the flexible arm 40, the lug 15, and the spacer 50 help to ensure that the gap 52,54 remains substantially constant throughout most if not all engine operating conditions.

It can therefore be appreciated that by not constraining the thermal expansion of the LED 17 and/or its distal flange 20, the sliding joint 30 helps to "off load" the support pins 27 as the LED 17 expands in the axial direction. This further helps to reduce or eliminate the instances of fretting.

Figure 7:
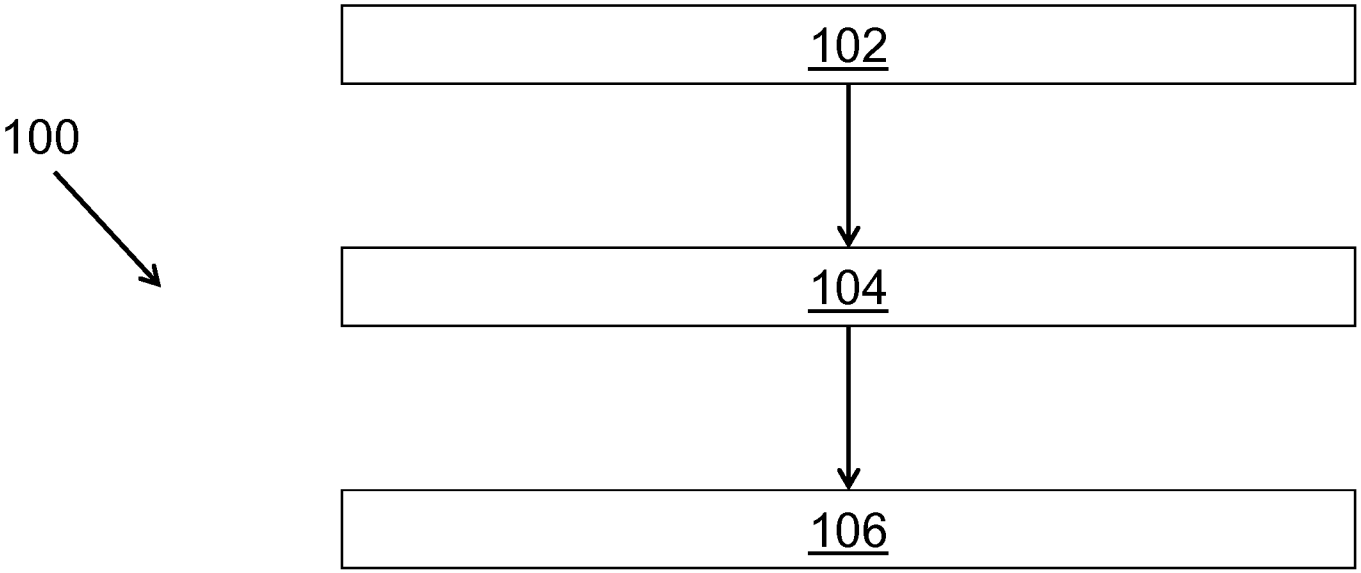
FIG. 7 is a schematic view of a method of axially displacing a combustor with respect to a turbine vane assembly of a gas turbine engine, according to yet another embodiment of the present disclosure.

Referring to FIG. 7, there is also provided a method 100 of axially displacing the combustor with respect to the turbine vane assembly.

The method 100 includes joining the first end of the elongated flexible arm to the outer surface of the combustor, represented in FIG. 7 as 102. The joining of the first end of the arm can be performed by welding, brazing, or otherwise attaching the two components together. Such a joining of the arm to the combustor places the arm on the "cold side" of the combustor, as previously explained.

The method 100 also includes placing a free second end of the flexible arm radially inward of the outer surface and adjacent to a leading edge lug of the turbine vane assembly, represented in FIG. 7 as 104. Such a positioning of the second end of the arm places the entire arm, and thus the entire sliding joint, on the "cold side" of the combustor, as previously explained. Optionally, the free second end can be placed radially inward of the lug and in opposed spaced relationship with the lug, such that the lug is placed radially between the outer surface of the combustor and the free second end of the arm. The placement of the free second end radially inward of the lug can define a gap between the lug and the free second end. This gap defines an operational tolerance between the second end and the lug, thereby allowing the second end to be displaced with respect to the lug. Further optionally, the free second end or a component attached thereto (e.g. a spacer) can be abraded or otherwise machined in order to obtain the operational tolerance.

The method 100 also includes displacing the second end of the flexible arm along an axial direction with respect to the lug of the turbine vane assembly when the combustor undergoes thermal expansion, represented in FIG. 7 as 106. The thermal expansion experienced by the LED and caused by the hot combustion gases causes the LED to displace along an axial direction. The flexible arm, which is attached to the LED, and the second end will therefore also displace or slide along the axial direction with respect to the lug, which is fixed in place. As previously mentioned, the LED or some portion thereof (e.g. its distal flange) can shield the second end of the arm from the hot combustion gases within the combustor.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A sliding joint between a large exit duct of a combustor of a gas turbine engine and a turbine vane assembly having a leading edge lug, the large exit duct having a distal flange defining an inner surface and an outer surface, the sliding joint comprising:

an elongated flexible arm made from a resilient sheet metal and extending between a first end joined to the outer surface of the distal flange and an opposed free second end disposed radially inward of the distal flange, the flexible arm having a first surface and a second surface spaced radially inward from the first surface, the flexible arm being made from a material having a coefficient of thermal expansion being greater than a coefficient of thermal expansion of the distal flange; and a spacer joined to the first surface of the second end of the flexible arm and projecting radially away therefrom toward the distal flange, the spacer made of an abradable material and spaced apart from the distal flange and defining a gap therebetween, the spacer axially displacing with respect to the lug upon thermal expansion of the large exit duct.

2. The sliding joint as defined in claim 1, wherein the second end of the flexible arm is disposed radially inward of the lug of the turbine vane assembly and in opposed spaced relation therewith defining a second gap therebetween.

3. The sliding joint as defined in claim 2, wherein the spacer projects radially away from the first surface of the second end within the second gap and toward the lug of the turbine vane assembly.

4. The sliding joint as defined in claim 1, further comprising an elongated second flexible arm extending between a fixed end joined to the turbine vane assembly and an opposed unattached end disposed radially inward of the distal flange, the second flexible arm having a third surface and a fourth surface spaced radially inward of the third surface.

5. The sliding joint as defined in claim 4, further comprising a second spacer joined to the fourth surface of the unattached end of the second flexible arm and projecting radially inward toward the spacer of the flexible arm, the second spacer spaced apart from the spacer and defining a spacer gap therebetween, the spacer axially displacing with respect to the second spacer upon thermal expansion of the large exit duct.

6. The sliding joint as defined in claim 1, wherein the flexible arm is made from a sheet metal having a first gauge, and the spacer is made from a sheet metal having a second gauge, the second gauge being greater than the first gauge.

7. The sliding joint as defined in claim 1, wherein the flexible arm has at least one cooling hole extending through the flexible arm between the first surface and the second surface.

8. A gas turbine engine, comprising:

a combustor defining a flowpath extending downstream from an upstream dome end towards a combustor exit, the upstream dome end being in fluid communication with a large exit duct and a small exit duct to define a combustion chamber therewithin, the large exit duct having a distal flange defining an inner surface facing the combustion chamber, and an outer surface, the distal flange being made from a material having a coefficient of thermal expansion;

a turbine vane assembly disposed downstream of the combustor and having at least one turbine vane and a leading edge lug, the leading edge lug is disposed radially inwardly of the distal flange and overlapped by the distal flange; and a sliding joint disposed between the combustor and the turbine vane assembly, the sliding joint comprising:

an elongated flexible arm made from a resilient sheet metal and extending between a first end joined to the outer surface of the distal flange of the large exit duct, and an opposed free second end disposed radially inward of the distal flange, the flexible arm having a first surface and a second surface spaced radially inward from the first surface, the flexible arm being made from a material having a coefficient of thermal expansion being greater than the coefficient of thermal expansion of the distal flange; and a spacer joined to the first surface of the second end of the flexible arm and projecting radially away therefrom toward the distal flange, the spacer spaced apart from the distal flange and defining a gap therebetween, the spacer axially displacing with respect to the leading edge lug upon thermal expansion of the large exit duct of the combustor.

9. The gas turbine engine as defined in claim 8, wherein the leading edge lug of the turbine vane assembly is disposed in the gap between the second end of the flexible arm and the distal flange, the second end of the flexible arm disposed radially inward of the leading edge lug of the turbine vane assembly and in opposed spaced relation therewith defining a second gap therebetween.

10. The gas turbine engine as defined in claim 9, wherein the spacer projects radially away from the first surface of the second end within the second gap and toward the leading edge lug of the turbine vane assembly.

11. The gas turbine engine as defined in claim 8, further comprising an elongated second flexible arm extending between a fixed end joined to the turbine vane assembly and an opposed unattached end disposed radially inward of the distal flange, the second flexible arm having a third surface and a fourth surface spaced radially inward of the third surface.

12. The gas turbine engine as defined in claim 11, further comprising a second spacer joined to the fourth surface of the unattached end of the second flexible arm and projecting radially inward toward the spacer of the flexible arm, the second spacer spaced apart from the spacer and defining a spacer gap therebetween, the spacer axially displacing with respect to the second spacer upon thermal expansion of the large exit duct.

13. The gas turbine engine as defined in claim 8, wherein the flexible arm is made from a sheet metal having a first gauge, and the spacer is made from a sheet metal having a second gauge, the second gauge being greater than the first gauge.

* * * * *